US006485331B1

(12) United States Patent
Lample

(10) Patent No.: US 6,485,331 B1
(45) Date of Patent: Nov. 26, 2002

(54) CONNECTION SYSTEM OPERATING IN VACUUM FOR HIGH-VOLTAGE CURRENTS

(75) Inventor: Regis Lample, Gramat (FR)

(73) Assignee: Etat Francais represente par le Delegue, General pour l'Armement (FR)

( * ) Notice: Subject to any disclaimer, the term of this patent is extended or adjusted under 35 U.S.C. 154(b) by 0 days.

(21) Appl. No.: 09/976,844

(22) Filed: Oct. 15, 2001

(30) Foreign Application Priority Data

Oct. 5, 2000 (FR) ..... 00 12701

(51) Int. Cl.[7] ..... H01R 9/05
(52) U.S. Cl. ..... 439/578; 439/279
(58) Field of Search ..... 439/578–589, 439/271–283

(56) References Cited

U.S. PATENT DOCUMENTS 3,806,625 A 4/1974 Long ..... 174/31 R
4,060,299 A 11/1977 Williams ..... 439/289
5,800,195 A * 9/1998 Endo et al. ..... 439/271
5,823,824 A * 10/1998 Mitamura et al. ..... 439/585

FOREIGN PATENT DOCUMENTS

DE 36 40 180 A1 6/1988
FR 2 578 690 9/1986

* cited by examiner

*Primary Examiner*—P. Austin Bradley
*Assistant Examiner*—Ross Gushi
(74) *Attorney, Agent, or Firm*—Parkhurst & Wendel, L.L.P.

(57) ABSTRACT

The present invention relates to a connection system for electrical cables which operate under vacuum and carry high-voltage electric pulses or currents.

Figure 1:
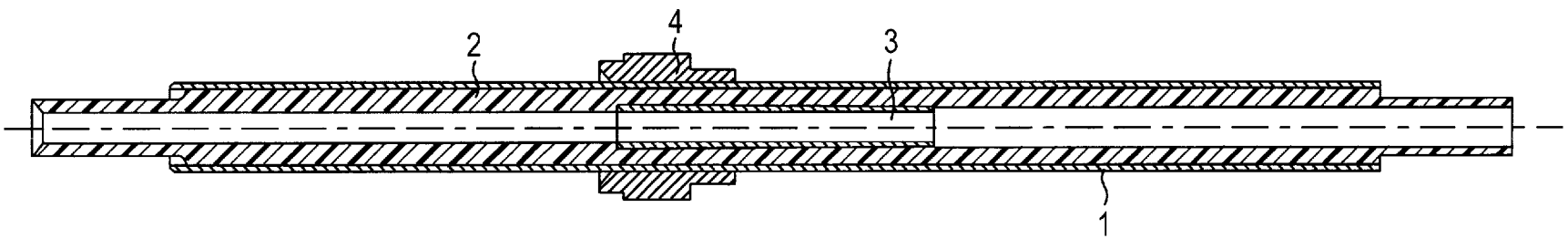

This connection system comprises a grounded outer metal shell connected to the cables' metal sheath and a dielectric insulating sleeve, said sheath and sleeve enclosing the cables to be connected, and said system is fitted with seals allowing subtending a sealed cavity between the cables' insulating sleeve and insulating sheath.

10 Claims, 3 Drawing Sheets

CONNECTION SYSTEM OPERATING IN VACUUM FOR HIGH-VOLTAGE CURRENTS

The technical field of the present invention covers connection systems for high-voltage currents (several tens of kv).

In this field the industrial applications sometimes require cables carrying high-voltage currents—which also may exhibit of high and variable densities—to cross what in general are metallic walls. A particular problem arises when a vacuum—or sealing relative to another gas—must be maintained on one side of the wall. The same difficulty is encountered when two cables of this kind must be connected in vacuum.

Several types of connection systems are presently available to solve the problem of high-voltage cable connection or wall feedthroughs. Such devices can be found in high-voltage coax(ial) connector catalogues published by specialized suppliers such as RADIALL, ALCATEL, ETAT, LEYBOLD, PFEIFFER, VARIAN or VEECO. Most of these devices consist of a set of a male and female connector elements (to connect one insulated coaxial line to another which is also insulated) or of a wall-mounted connector element and a plug (when joining an insulated coax line to a non-insulated line in air). One of the two connector elements, or the wall-mounted connector element, is then affixed to the wall being crossed and hermeticity is assured by conventional seals on the two sides of the wall.

However, because these connector elements entail electrical contact and a break in dielectric on each side of the wall, they will operate properly under high voltage only if the connection is implemented at atmospheric pressure. As soon as these connector elements are made to operate in vacuum, arcing arises at the surface along the dielectric junctions of the connection systems and the voltage drops.

Moreover the conventional plug-jack connections entail high inductance on account of the substantially different diameters of the inner and outer conductors, said high inductances hampering rapid pulse propagation for instance from a capacitor discharge through the connection. While operation remains feasible by increasing the power of the current generator when using DC, the problem becomes practically prohibitively difficult if a high current is desired by a very fast capacitor discharge.

Moreover the conventional connection systems permanently affix either the case of one of the connectors, or the wall-mounted element to the wall, thereby precluding rapid engagement and disengagement of the cable ends with and from the wall.

Therefore it is the objective of the present invention to create a connection system wherein the dielectrics remain immersed in a gas atmosphere or any other fluid even when part of the connection system is in a vacuum. The invention moreover implements its connection by retaining a coaxial geometry which is close to that of the cables and in this manner allows easily disengaging both cables from the wall to which they are mounted.

The connection systems of the invention are able to withstand voltages that per se do not restrict the application of this invention, even in a deep vacuum, because the configuration of the invention, by means of an increase in length of the connection system, allows adjusting its arcing strength merely by increasing the length of the dielectric on which the electric arc might travel. Significantly the increase in length does not entail increased radial bulk, and consequently the connection inductance is not increased.

For that purpose the invention proposes a connection system comprising a metal outer shell connected to the grounding braids of the cables to be joined, furthermore a dielectrically insulating sleeve inside said metal shell and enclosing the inner conductors of the two cables and their insulating sheaths, said connection system being fitted with a sealed cavity between the insulating sheaths of the cables being joined and the insulating, dielectric sleeve; said cavity is always exposed to a gas, preferably atmospheric air introduced in the cavity during assembly, or it remains filled with a hydraulic fluid even when the connection system or part of it is placed into an enclosure under vacuum. The gas pressure or the presence of the fluid shall be preserved in said cavity by using seals situated on one hand on the end of one of the two cables and on the other hand between the dielectrics of the particular cable sheath and the end of the insulating sleeve. Sealing the cable end must be implemented both on the inner cable conductor to preclude leaks through the cable inside and on the insulating sheath in order to attain the desired sealed cavity.

Where the cable must cross a wall separating a gas atmosphere from an enclosure at vacuum, sealing can be implemented only at one end of the dielectric sleeve; on the other hand, if the connection system is meant to be fully situated in a vacuum, sealing will be required at the ends of both cables and at the ends of the insulating sleeve.

Preferably the outer metal shell and the dielectric, insulating sleeve exhibit a cylindrical cross-section in order to enclose at minimal bulk the cable ends and hence entailing minimal inductance, further to assure good shielding against electromagnetic radiations. Moreover said shell and sleeve also may consist of two tubes, one being metallic, the other a dielectric, which nest in each and are affixed to each other. In particular this configuration offers the advantage of easily positioning the cables inside the metal shell and dielectric insulating sleeve and facilitate maintenance of the assembly.

Preferably the cable end may be sealed by a plug crimped on the cable and its insulating sheath. If necessary the plug shall be soldered on the inner conductor to seal off the inside of the cable inner conductor.

Preferably the cavity at the end of the sleeve is sealed by inserting an O-ring between the insulating sleeve's dielectric and the dielectric of the insulating sheath of the cable being hooked up.

To assure easy dismantling of the two cables from the wall, the invention proposes that the cable ends, which preferably are fitted with plugs soldered onto the inner conductors, shall be connected using jacks receiving said plugs.

Lastly dismantling is made easy by adding detachable fasteners of the cables' metal sheaths on the outer metal sheath.

This device of the invention offers the advantage allowing connecting high-voltage carrying coax cables—where said voltages may reach and even exceed 100 kv—and to make use of such cables at very low pressures, and even in a deep vacuum that may be as low as $10^{-7}$ mbars, this limit being set by the mechanical strength of the elastomer dielectrics in vacuum and the associated surface degassing, without electric discharges taking place at the junctions between the dielectrics.

Said device of the invention also allows making the connection without generating electromagnetic interference thanks to the shielding continuity around these elements.

Another advantage of the invention is that the proposed axial geometry of the opposite dielectric, namely the insulating sleeve dielectric and the insulating sheath dielectric of the cable, entails a connection inductance which is close to that of the cable and that consequently this kind of connection system assures the transmission of high-voltage electric pulses at minimal losses caused by counter-electromotive forces. By preserving the axial structure, the advantages of the low-voltage connection systems are thus retained.

Moreover the axial configuration offers the advantage that this connection takes place in a cylindrical volume of small diameter.

Lastly the device of the invention offers the advantage that with regard to its application as a wall feedthrough, it is easy to affix the cables to and remove them from the wall.

The invention is elucidated below in relation to the attached Figures.

FIG. 1 is a cross-section of the connection system's feedthrough section including the outer metal shell and the dielectric insulating sleeve, which in this embodiment are configured as two mutually bonded coaxial tubes that are fitted with collar to be fastened to wall being crossed, and a connection jack which shall receive two high-current plugs mounted on the ends of the inner conductors of the two cables to be hooked up.

Figure 2:
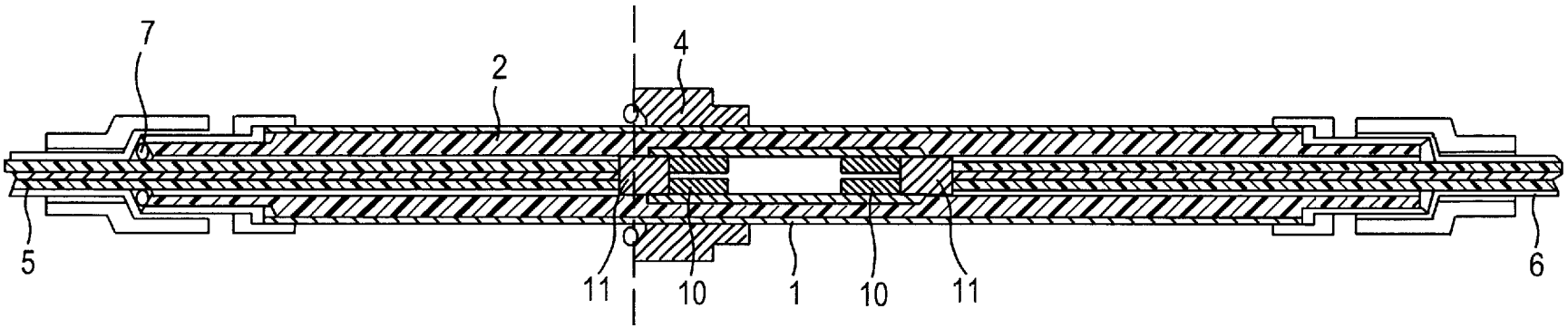

FIG. 2 is another section and shows the implemented feedthrough with the feedthrough segment as in FIG. 1, the two cables to be hooked up being in position and the two seals shown on the left of the Figure, that is in that configuration wherein the connection system shall be emplaced between an enclosure at the right at atmospheric pressure. FIG. 2 furthermore shows the cavity which is the objective of the present invention and determined by the space between the two dielectrics while being closed on one side by the cable crimp and on the other side by an O-ring, and FIG. 3 shows, again in section, an illustrative connection element between the outer metal shell and the metallic sheath of one of the cables to be connected and furthermore the crimping of a high-current plug onto that cable end which shall be situated on the side of the enclosure under vacuum.

FIG. 1 shows a feedthrough segment comprising an outer metal shell 1 enclosing a dielectric insulating sleeve 2, both said conductor and sleeve in this instance being adhesively bonded to each other, further a jack 3 that shall receive the high-current plugs affixed to the ends of the inner cable conductors, and a collar 4 which is affixed to the outer metal shell 1 and is used to affix the assembly to a wall to be crossed.

FIG. 2 shows the full wall feedthrough inclusive the set of elements already mentioned relative to FIG. 1, furthermore the left and right cables resp. 5 and 6, two enclosures partitioned by said wall (the left enclosure being at vacuum in the present Figure), and a seal 7 in the form of an O-ring.

Figure 3:
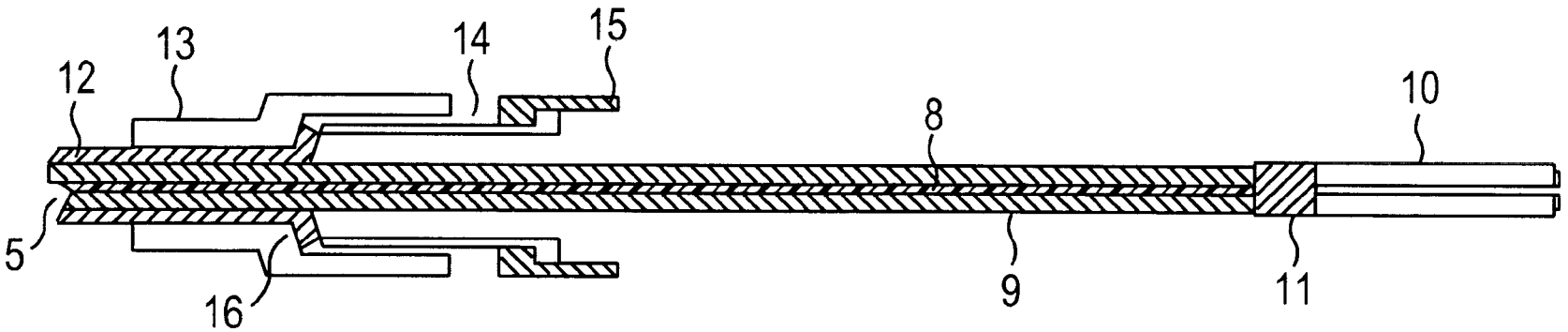

FIG. 3 shows in detail a cable end with its inner conductor 8, its insulating sheath 9, a high-current plug 10 affixed by a crimp 11 to said cable end, furthermore it shows a particular embodiment mode of the fastener affixing the metal shell 1 to the metal sheath 12 of the cable which is to be hooked up. This embodiment comprises a bush 13 and a threaded socket 14 which grips the ground braid 16 constituting the end of the metal sheath 12 of the cable 5, and a nut 15 locking said socket 14 against the metal shell 1.

This connection device operates as follows:

The feedthrough's outer metal shell 1 implements ground continuity with the ground braids 16 of the cables being connected to each other; in this manner said shell assures electromagnetic shielding of the connection against external interference and shields external systems from the current through said shell.

The dielectric insulating sleeve 2 separates as much as necessary the end of the internal cable connector (the "hot point") from the nearest metal in order to preclude electric discharge between them; the length of this insulating sleeve is adjustable in relation to the voltage desired at the hot point. Furthermore this insulating sleeve 2 shall entail an inductance which is near that of the cable line.

The junction socket 3 allows easy connection of the two cable ends to be hooked up, namely by a plain plug-in action, as a result of which the cables can be easily mounted on and dismantled from the wall feedthrough. Again the high-current plug 10 situated at each end of the two cables 5 and 6 facilitates connection to the socket 3 and assures a good contact and unattenuated current.

The principle of the invention implements a cavity between the two dielectrics 9 and 2 and seals this cavity by means of two seals 11 and 7. The air or fluid is trapped during assembly and thereby there shall be a gas or liquid in said cavity, hence preventing electric arcing between the cable end on one hand and on the other either the ground braid at the cable end or the wall, whereas, were said cavity lacking said seals, it would be at vacuum and discharges might occur.

A first sealing action is implemented at the cavity of the invention at the side of the cable end by a crimp 11 on the plug 10 and at the insulator 9 and to the cable inner conductor 8; in this manner said crimp prevents the fluid within this cavity from leaking through the inside of the inner cable conductor to the enclosure at vacuum. When the high-current plug itself is leaky, then the required sealing must be implemented for instance by soldering the strands of the inner conductor 8 and the plug 10.

Another sealing action is implemented at the other cavity end by a seal 7 emplaced at the end of the dielectric insulating sleeve 2 and assuring, in cooperation with cable insulator 9, that the cavity shall be closed to preclude the fluid contained it from leaking into the enclosure at vacuum.

When both connection system elements are in a vacuum, two crimps will be required and seals must be installed at each end of the dielectric, insulating sleeve 2.

In order to implement the invention, the following procedure may be followed: the metal shell and the insulating dielectric sleeve are tubes, one of copper, the other of PVC, and they are bonded to each other for better handling. The socket is inserted inside these tubes and may be bonded, and in this manner the two cables may be hooked up by merely plugging-in their ends. These two tubes are affixed to the wall requiring a feedthrough by means of a collar which in turn is bonded to the copper tube, and this tube by means of a thread compresses a seal and in this manner maintains sealing between the two sides of the wall.

The cables in question are conventional, of the 25 or 50 ohm type, and they are each fitted at their ends with a high-current plug that is soldered onto the multistrand inner conductor to assure sealing off the inside of the cable, said plug being crimped onto the polyethylene insulating sheath. The cable's ground braid is bared by removing its protective sheath and is clamped into a unit consisting of a bush affixed to the cable and of a socket in turn fitted with a nut for affixation onto the copper tube. An O-ring is set on the cable's polyethylene insulator and shall be forced into the end of the cavity by the PVC tube (which is beveled to receive the O-ring) when the cable is mounted on the connection system, and the compression of this O-ring between the PVC tube, the braid holding bush and the polyethylene sheath shall provide the desired sealing.

A device of the invention makes it possible to transmit a short electric pulse of more than 50 kv between an enclosure at atmospheric pressure and a vacuum of 10-6 mbars, without incurring discharges. Even lower vacua may be attained, the more so by selecting a dielectric withstanding such a vacuum for the cable's insulating sheath.

This invention offers substantial improvements in fields using high-voltage connections such as imaging, lasers, radiography and any technical field transmitting high-voltage currents in the form of short pulses.

What is claimed is:

1. A connection system for electrical coax(ial) cables (5, 6) each consisting of an inner conductor (8) and of an insulating sheath (9) which are enclosed in a metal sheath (12), the design of said connection system comprising a grounded outer metal shell (1) connected to the cables' metal sheaths and a dielectric insulating sleeve (2), both configured around the ends of the cables which must be hooked-up to each other, characterized in that said connection system also comprises a first seal situated on the end of at least one of the cables to be hooked up and on its insulating sheath, and a second seal on at least one end of the insulating sleeve (2) in order to bound a sealed cavity between said insulating sleeve and the cable's insulating sheath.

2. Connection system as claimed in claim 1, wherein the outer metal shell (1) and the dielectric insulating sleeve (2) each are cylindrical and mutually coaxial and configured along the hook-up axis of the cables.

3. Connection system as claimed in claim 2, wherein the outer metal shell and the dielectric insulating sleeve consist of a metal tube and of a dielectric tube which are mutually coaxial and linked to each other.

4. Connection system as claimed in claim 1, wherein the seal (11) on the end of one of the cables is implemented by crimping a plug onto the cable's insulating sheath.

5. Connection system as claimed in claim 1, wherein the seal (7) at one end of the insulating sleeve is an O-ring making contact on one hand with part of the cable's insulating sheath and on the other hand with the insulating sleeve enclosing the connection.

6. Connection system as claimed in claim 1, wherein the ends of the two cables to be hooked up and the two ends of the cavity subtended by the insulating sheath and sleeve are fitted with said seals (7) and (11).

7. Connection system as claimed in claim 1, wherein the ends of the cables' inner conductors are inserted into a metal socket (3).

8. Connection system as claimed in claim 1, which is fitted with detachable fasteners linking the metal sheath of at least one of at least one of the cables and the outer metal shell.

9. Application of the connection system defined in claim 1 to connecting electrical cables under vacuum, characterized in that the sealed cavity is filled with air at atmospheric pressure.

10. Application of the connection system defined in claim 1 to connecting electrical cables under vacuum, characterized in that the sealed cavity is filled with a hydraulic liquid.

* * * * *